US008805252B2

(12) United States Patent
Calamita

(10) Patent No.: US 8,805,252 B2
(45) Date of Patent: Aug. 12, 2014

(54) APPARATUS AND METHOD FOR LATERAL COLOR REGISTRATION PERFORMANCE AND PREVENTIVE MAINTENANCE DETECTION

(75) Inventor: James P. Calamita, Spencerport, NY (US)

(73) Assignee: Xerox Corporation, Norwalk, CT (US)

( * ) Notice: Subject to any disclaimer, the term of this patent is extended or adjusted under 35 U.S.C. 154(b) by 300 days.

(21) Appl. No.: 13/463,534

(22) Filed: May 3, 2012

(65) Prior Publication Data

US 2013/0294786 A1 Nov. 7, 2013

(51) Int. Cl.
*G03G 15/01* (2006.01)

(52) U.S. Cl.
USPC ..... 399/301

(58) Field of Classification Search
CPC ..... G03G 15/5079; G03G 15/6567; G03G 2215/0016
USPC ..... 399/49, 301
See application file for complete search history.

(56) References Cited

U.S. PATENT DOCUMENTS 6,603,574 B1 8/2003 Ramirez et al.

*Primary Examiner* — Walter L Lindsay, Jr.
*Assistant Examiner* — Barnabas Fekete
(74) *Attorney, Agent, or Firm* — Simpson & Simpson, PLLC

(57) ABSTRACT

A computer-based apparatus for preventive maintenance detection for a color printer including a photoreceptor belt (PB) arranged to displace in a process direction, including a memory element for storing a threshold value, computer readable instructions, and registration data for a plurality of markings on a surface of the PB, including for each marking, a respective registration difference, in a lateral direction orthogonal to the process direction, between a respective actual location and a respective original location. The apparatus includes a processor configured to execute the computer readable instructions to: determine that at least one marking from the plurality of markings is out of compliance with the at least one threshold value; and in response to determining that at least one marking from the plurality of markings is out of compliance with the at least one threshold value, transmit a signal, indicating that maintenance is required for the PB, for display.

20 Claims, 2 Drawing Sheets

APPARATUS AND METHOD FOR LATERAL COLOR REGISTRATION PERFORMANCE AND PREVENTIVE MAINTENANCE DETECTION

TECHNICAL FIELD

The present disclosure relates to an apparatus and method for determining misalignment of a photoreceptor belt in a xerographic device and providing a signal indicating that maintenance of the device and belt is required.

BACKGROUND

In a typical xerographic device, such as a printer, a photoconductor, such as photoreceptor belt (PB), that receives the image is displaced, or revolved, in a process direction. Photoconductors become conductive when exposed to light and are insulative when in the dark. Initially, the photoconductor has a uniform surface potential associated with it. The next step is to expose the image of a document onto the surface of the photoconductor. The imaged areas of the photoconductor remain unexposed and charged, while the areas that receive light become neutralized. The neutralized areas are due to the fact that the charge is drained away from the surface of the photoconductor to a metalized ground. What remains is the electrostatic latent image. This electrostatic image can then be developed. A typical photoconductor layer is usually around 10-50 $^{1}$m and is coated onto a ground plane. Photoreceptors are typically made into webs or seamless PBs.

Photoconductors typically exhibit basic properties. The electrical conductivity of a photoconductor in the dark must be that of a good insulator. Good insulating qualities are important so that charge patterns can be retained for a period of time long enough to complete the development process. The material must also become electrically conducting during exposure to light. In this way an electrostatic image pattern can be formed on its surface by either optical or laser means. The photoconductor should be fairly strong and be able to with stand continuous charging, discharging by light energy, cleaning, and recharging in the dark. Photoconductors also have dark current associated with them. That is, even when a photoconductor has been charged and is shielded from any source of light, there is still leakage current that flows. The dark current that flows is a result of thermal activity in the photogenerating medium. This decay rate must be accounted for and is kept within certain constraints.

As noted above, in a typical xerographic device, such as a printer, a PB is displaced, or revolved, in a process direction and steered in lateral direction, orthogonal to the process direction, to maintain stable motion and lateral registration (stable orientation and alignment in the lateral direction), in order to minimize color-to-color registration error. The edge of a PB is not perfectly straight due to tolerances involved in the fabrication of the PB. Therefore, upon initial installation of a PB in a xerographic device, contact-type edge sensors detect a shape of the PB edge and data regarding the shape of the edge is used to steer the PB as the PB revolves in the process direction. That is, the shape of the PB edge is "learned" via the contact-type sensors, and any steering of the PB is performed according to the learned shape.

However, as a PB is used, the shape of the edge changes due to wear, edge curl, and other factors. Thus, the learned edge, which is being used to steer the PB, no longer correlates to the actual edge, causing lateral misregistration. If the lateral misregistration exceeds a threshold, a fault is registered by the xerographic device and/or the output of the xerographic device becomes unacceptable. At this point, customer server personnel, engineering support personnel, or field support personnel must be engaged to identify and resolve the problem. Unacceptable performance of the device results in user dissatisfaction and undesirable downtime, while engagement of the personnel noted above results in undesirable downtime as well as undesirable costs for the user or the supplier of the xerographic device.

It is known to provide image registration systems for the correct and accurate alignment, relative to one another, on both axes, of different plural color images on an initial imaging bearing surface member such as (but not limited to) a PB of a xerographic color printer. That is, to improve the registration accuracy of such plural color images relative to one another and/or to the image bearing member In particular, it is known to provide such imaging registration systems by means of marks-on-belt (MOB) systems, in which edge areas of the image bearing belt laterally within or outside of its normal imaging area are marked with registration positional marks, detectable by an optical sensor. Typically, the MOB system uses distinctive marks, such as "chevron" shaped registration marks, imaged with, and adjacent to, the respective image, and developed with the same toner or other developer material as is being used to develop the associated image, in positions corresponding to, but outside of, the image position, such as putting the marks along the side of the image position or in the inter-image zone between the images for two consecutive prints. Such MOB image position or registration indicia, are thus typically repeatedly developed and erased in each rotation of the photoreceptor belt.

SUMMARY

According to aspects illustrated herein, there is provided a computer-based method for preventive maintenance detection for a color printer including a photoreceptor belt (PB) arranged to displace in a process direction, including: storing, in a memory element of a computer; at least one threshold value; computer readable instructions; and registration data for a plurality of markings, associated with a first color, on a surface of the PB, the registration data including for each marking in the plurality of markings, a respective registration difference, in a lateral direction orthogonal to the process direction, between a respective actual location and a respective original location; and executing, using a processor for the computer, the computer readable instructions to: determine that at least one marking from the plurality of markings is out of compliance with the at least one threshold value; and in response to determining that at least one marking from the plurality of markings is out of compliance with the at least one threshold value, transmit a signal, indicating that maintenance is required for the PB, for display.

According to aspects illustrated herein, there is provided a computer-based apparatus for preventive maintenance detection for a color printer including a photoreceptor belt (PB) arranged to displace in a process direction, including a memory element for a computer arranged to store at least one threshold value, computer readable instructions, and registration data for a plurality of markings, associated with a first color, on a surface of the PB, the registration data including for each marking in the plurality of markings, a respective registration difference, in a lateral direction orthogonal to the process direction, between a respective actual location and a respective original location. The apparatus includes a processor for the computer configured to execute the computer readable instructions to: determine that at least one marking from the plurality of markings is out of compliance with the at least one threshold value; and in response to determining that at least one marking from the plurality of markings is out of compliance with the at least one threshold value, transmit a signal, indicating that maintenance is required for the PB, for display.

According to aspects illustrated herein, there is provided a computer-based method for preventive maintenance detection for a color printer including a photoreceptor belt (PB) arranged to displace in a process direction, including: storing, in a memory element of a computer: a first distance; computer readable instructions; and registration data for a plurality of markings, associated with a first color, on a surface of the PB, the registration data including for each marking in the plurality of markings, a respective registration difference, in a lateral direction orthogonal to the process direction, between a respective actual location and a respective original location. The method includes executing, using a processor for the computer, the computer readable instructions to: identify a first marking with a smallest respective registration difference; identify a second marking with a largest respective registration difference; determine a first difference between the smallest and largest respective registration differences; determine that the first difference is greater than the first distance; in response to determining that the first difference is greater than the first distance, identifying a registration error for the PB; and in response to identifying a registration error, transmit a signal, indicating that maintenance is required for the PB, for display.

According to aspects illustrated herein, there is provided a computer-based apparatus for preventive maintenance detection for a color printer including a photoreceptor belt (PB) arranged to displace in a process direction, including a memory element for a computer arranged to store a first distance, computer readable instructions, and registration data for a plurality of markings, associated with a first color, on a surface of the PB, the registration data including for each marking in the plurality of markings, a respective registration difference, in a lateral direction orthogonal to the process direction, between a respective actual location and a respective original location. The apparatus includes a processor for the computer configured to execute the computer readable instructions to: identify a first marking with a smallest respective registration difference; identify a second marking with a largest respective registration difference; determine a first difference between the smallest and largest respective registration differences; determine that the first difference is greater than the first distance; in response to determining that the first difference is greater than the first distance, identifying a registration error for the PB; and in response to identifying a registration error, transmit a signal, indicating that maintenance is required for the PB, for display.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

As used herein, the words "printer," "printer system", "printing system", "printer device" and "printing device" as used herein are interchangeable and encompasses any apparatus, such as a digital copier, bookmaking machine, facsimile machine, multi-function machine, etc. which performs a print outputting function for any purpose, while "multi-function device" and "MFD" as used herein is intended to mean a device which includes a plurality of different imaging devices, including but not limited to, a printer, a copier, a fax machine and/or a scanner, and may further provide a connection to a local area network, a wide area network, an Ethernet based network or the interact, either via a wired connection or a wireless connection. An MFD can further refer to any hardware that combines several functions in one unit. For example, MFDs may include but are not limited to a standalone printer, a server, one or more personal computers, a standalone scanner, a mobile phone, an MP3 player, audio electronics, video electronics, GPS systems, televisions, recording and/or reproducing media or any other type of consumer or non-consumer analog and/or digital electronics.

Moreover, although any methods, devices or materials similar or equivalent to those described herein can be used in the practice or testing of these embodiments, some embodiments of methods, devices, and materials are now described.

Figure 1:
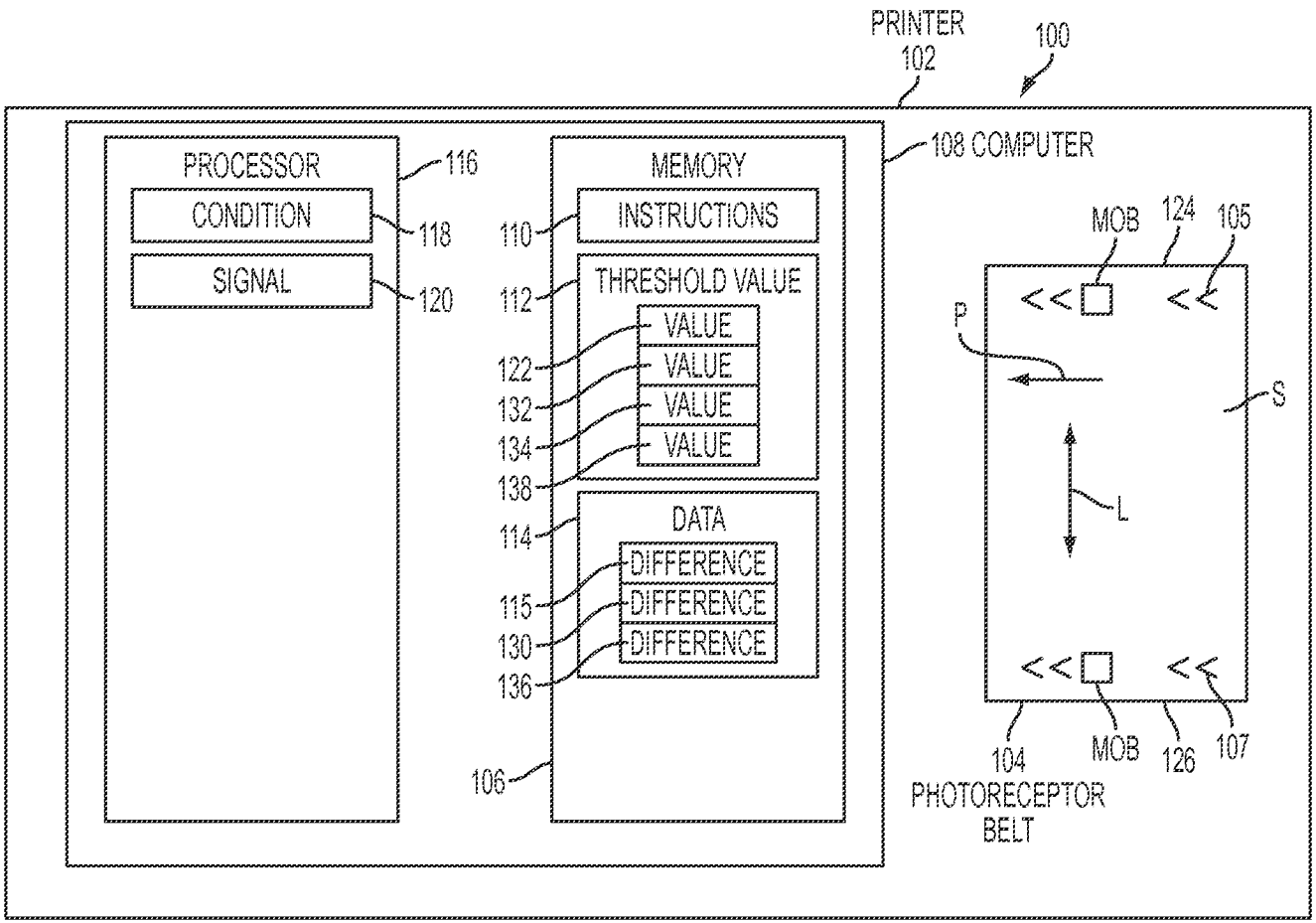
FIG. 1 is a schematic block diagram of an apparatus for preventive maintenance detection for a printer including a photoreceptor belt; and, FIG. 2 is a graph illustrating a sinusoidal error pattern for color to color misregistration measured on the surface of a photoreceptor belt.

FIG. 1 is a schematic block diagram of apparatus 100 for preventive maintenance detection for printer 102 including photoreceptor belt (PB) 104 arranged to displace in process direction P. PB includes a plurality of color registration markings 105 and 107 on surface S of the PB. Apparatus 100 includes memory element 106 for computer 108 arranged to store computer readable instructions 110, at least one threshold value 112, and registration data 114 for markings 105 and 107. In an example embodiment, computer 108 is onboard the printer. In an example embodiment, data 114 is gathered using mark on belt (MOB) sensors. Data 114 is associated with a particular color for the printer, for example, magenta. The data includes, for each marking 105 and 107, a respective registration difference 115, in lateral direction L, orthogonal to the process direction, between a respective actual location and a respective original location. For example, the original locations are the locations according to the learned shape of the PB edge as described above, that is, the expected locations if the shape of the edge of the PB is substantially the same as initially measured by the contact-sensors, as described above. Stated otherwise, data 114 represents color to color registration on the surface of PB. It should be understood that any number, shape, or configuration of color registration markings known in the art can be used for markings 105 and 107.

The apparatus also includes processor 116 for the computer configured to execute the computer readable instructions to identify condition 118, which is a determination that at least a portion of markings 105 or 107 is out of compliance with the at least one threshold value. That is, at least a portion of the shape of the edge of the PB has changed from the learned shape enough to affect color registration. In response to identifying condition 118, the processor is configured to execute the computer readable instructions to transmit signal 120, indicating that maintenance is required for PB, for display. For example, signal 120 includes a message that the lateral alignment of PB needs to be adjusted. In an example embodiment, signal 120 includes instructions for the user of the printer to run a maintenance routine that will "relearn" the shape of the edge of the PB. That is, the data used to laterally steer the PB is updated to account for the actual shape of the edge. This routine does not require intervention by customer server personnel, engineering support personnel, or field support personnel.

In an example embodiment, the at least one threshold value includes threshold value 122, which is a distance, and the PB includes inboard and outboard edges 124 and 126, respectively, disposed along the process direction. Markings 105 and 107 are located proximate the inboard and outboard edges, respectively, as noted above. In an example embodiment, respective pairs of markings 105 and 107 are aligned in lateral direction L. The discussion that follows is directed to inboard edge 124; however, it should be understood that the discussion also is applicable to outboard edge 126. In this example, the processor is configured to execute the computer readable instructions to determine whether at least a portion of markings 105 is out of compliance with threshold value 118 by identifying a marking 105-S with a smallest respective registration difference 115 and a marking 105-L with a largest registration difference 115. The processor is configured to execute the computer readable instructions to determine whether difference 130 between the respective registration differences 115 for 105-S and 105-L is greater than value 122. If so, the processor identifies 105-L as being out of compliance, that is, condition 118 is identified.

In an example embodiment, threshold value 112 includes threshold value 132, which is a distance. The processor is configured to execute the computer readable instructions to identify condition 118 only when difference 130 between the respective registration differences 115 for 105-S and 105-L is greater than threshold value 122 and less than threshold value 132. The comparison to value 132 is used to filter out readings that are not plausible (unrealistically large), for example, due to noise or an error related to a sensor.

In an example embodiment, the processor is configured to execute the computer readable instructions to evaluate markings 105 and 107 simultaneously. The processor determines whether at least a portion of markings 105 and 107 is out of compliance with the at least one threshold value by determining whether at least one marking 105 and at least one marking 107 are both out of compliance with the at least one threshold value. If so, condition 118 is identified.

For example, the process described above is implemented to identify markings 105-S and 105-L. Threshold value 118 includes value 134, which is a distance. The processor is configured to execute the computer readable instructions to determine whether at least a portion of markings 107 is out of compliance with threshold value 118 by identifying a marking 107-S with a smallest respective registration difference 115 and a marking 1074, with a largest registration difference 115. The processor is configured to execute the computer readable instructions to determine whether difference 136 between the respective registration differences 115 for 107-S and 107-L is greater than value 134. If so, and difference 130 between the respective registration differences 115 for 105-S and 105-L is greater than value 122, the processor identifies condition 118. That is, at least a portion of both markings 105 and 107 are out of compliance. It should be understood that values 122 and 134 can be the same or different.

In an example embodiment, threshold value 112 includes threshold value 138, which is a distance. The processor is configured to execute the computer readable instructions to identify condition 118 only when difference 130 between the respective registration differences 115 for 105-S and 105-L is greater than threshold value 122 and less than threshold value 132 and difference 136 between the respective registration differences 115 for 107-S and 107-L is greater than threshold value 134 and less than threshold value 138 The comparison to value 138 is used to filter out readings that are not plausible (unrealistically large), for example, due to noise or an error related to a sensor. It should be understood that values 132 and 138 can be the same or different.

Figure 2:
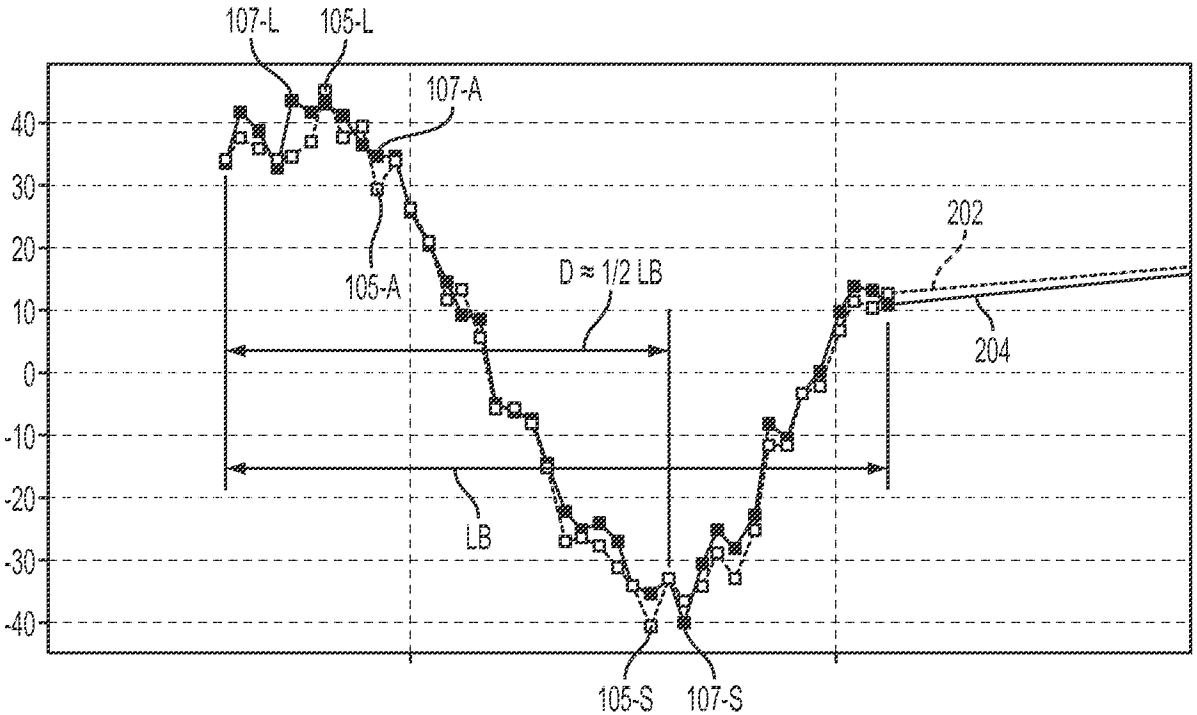

FIG. 2 is graph 200 illustrating a sinusoidal error pattern for color to color misregistration measured on the surface of a photoreceptor belt. Line 202 is for inboard markings 105 and line 204 is for outboard markings 107. The Y axis in the graph is distance in the lateral direction and the X axis is distance along the belt in the P direction. For example, the X axis plots differences 130 and 136 for markings 105 and 107, respectively, in direction L. In the example of FIG. 2, respective markings 105 and 107 are matched with respect to location in the P direction (aligned in the L direction), that is, pairs of markings 105 and 107, for example 105-A and 107-A overlap on the X axis.

Markings 105-L and 107-L, described above, and markings 105-S and 107-S, also described above, are shown in FIG. 2. The entire PB includes a length LB in the process direction (in practice the actual distance for LB for which data 114 is gathered may be slightly less than the full length of PB). That is, starting at a point on PB and progressing along the belt in direction P, after a distance LB, the point would be encountered again. In an example embodiment, the processor is configured to evaluate a distance D in the process direction between points 105-S and 105-L, or 107-S and 107-L. If D is substantially equal to one half of LB, then lines 202 and 204 are typically sinusoidal in shape, which is indicative of color misregistration that is due to steering the belt to a poorly learned or out of date belt edge form. A certain amount of tolerance, for example +/− two or three data points (markings), with respect to D can be considered to account for noise in the system. In an example embodiment, the processor identifies condition 118 only if D is substantially equal to one half of LB within a specified tolerance.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A computer-based method for preventive maintenance detection for a color printer including a photoreceptor belt (PB) arranged to displace in a process direction, comprising:

storing, in a memory element of a computer:

at least one threshold value;

computer readable instructions; and, registration data for a plurality of markings, associated with a first color, on a surface of the PB, the registration data including for each marking in the plurality of markings, a respective registration difference, in a lateral direction orthogonal to the process direction, between a respective actual location and a respective original location; and, executing, using a processor for the computer, the computer readable instructions to:

determine that at least one marking from the plurality of markings is out of compliance with the at least one threshold value; and, in response to determining that at least one marking from the plurality of markings is out of compliance with the at least one threshold value, transmit a signal, indicating that maintenance is required for the PB, for display.

2. The computer-based method of claim 1, wherein:

the at least one threshold value includes a first distance; and, determining that at least one marking from the plurality of markings is out of compliance with the at least one threshold value includes:

identifying a first marking with a smallest respective registration difference;

identifying a second marking with a largest respective registration difference;

determining a first difference between the smallest and largest respective registration differences; and, determining that the first difference is greater than the first distance.

3. The computer-based method of claim 2, wherein the entire PB includes a length in the process direction, the method further comprising executing, using the processor, the computer readable instructions to determine a distance in the process direction between the first and second markings, wherein determining that at least one marking from the plurality of markings is out of compliance with the at least one threshold value includes making the determination only if the distance is substantially equal to one half of the length.

4. The computer-based method of claim 3, wherein:

the at least one threshold value includes a second distance; and, determining that at least one marking from the plurality of markings is out of compliance with the at least one threshold value includes determining that the first difference is less than the second distance.

5. The computer-based method of claim 1, wherein:

the PB includes first and second edges in the process direction;

the plurality of markings includes:

a first plurality of inboard markings proximate the first edge; and, a second plurality of outboard markings proximate the second edge; and, determining that at least one marking from the plurality of markings is out of compliance with the at least one threshold value includes determining that at least one inboard marking and at least one outboard markings are both out of compliance with the at least one threshold value.

6. The computer-based method of claim 5, wherein:

the at least one threshold value includes a first distance; and, determining that at least one inboard marking and at least one outboard markings are both out of compliance with the at least one threshold value includes:

identifying first inboard and outboard markings with smallest respective registration differences;

identifying second inboard and outboard markings with largest respective registration differences;

determining a first difference between the smallest and largest respective registration differences for the first and second inboard markings;

determining a second difference between the smallest and largest respective registration differences for the first and second outboard markings; and, determining that the first and second differences are both greater than the first distance.

7. The computer-based method of claim 6, wherein:

the at least one threshold value includes a second distance; and, determining that at least one inboard marking and at least one outboard markings are both out of compliance with the at least one threshold value includes determining that the first and second differences are each less than the second distance.

8. A computer-based apparatus for preventive maintenance detection for a color printer including a photoreceptor belt (PB) arranged to displace in a process direction, comprising:

a memory element for a computer arranged to store at least one threshold value, computer readable instructions, and registration data for a plurality of markings, associated with a first color, on a surface of the PB, the registration data including for each marking in the plurality of markings, a respective registration difference, in a lateral direction orthogonal to the process direction, between a respective actual location and a respective original location; and, a processor for the computer configured to execute the computer readable instructions to:

determine that at least one marking from the plurality of markings is out of compliance with the at least one threshold value; and, in response to determining that at least one marking from the plurality of markings is out of compliance with the at least one threshold value, transmit a signal, indicating that maintenance is required for the PB, for display.

9. The computer-based apparatus of claim 8, wherein:

the at least one threshold value includes a first distance; and, determining that at least one marking from the plurality of markings is out of compliance with the at least one threshold value includes:

identifying a first marking with a smallest respective registration difference;

identifying a second marking with a largest respective registration difference;

determining a first difference between the smallest and largest respective registration differences; and, determining that the first difference is greater than the first distance.

10. The computer-based apparatus of claim 9, wherein:

the entire PB includes a length in the process direction;

the processor is arranged to execute the computer readable instructions to determine a distance in the process direction between the first and second markings; and, determining that at least one marking from the plurality of markings is out of compliance with the at least one threshold value includes making the determination only if the distance is substantially equal to one half of the length.

11. The computer-based apparatus of claim 9, wherein:

the at least one threshold value includes a second distance; and, determining that at least one marking from the plurality of markings is out of compliance with the at least one threshold value includes determining that the first difference is less than the second distance.

12. The computer-based apparatus of claim 8, wherein:

the PB includes first and second edges in the process direction;

the plurality of markings includes:

a first plurality of inboard markings proximate the first edge; and, a second plurality of outboard markings proximate the second edge; and, determining that at least one marking from the plurality of markings is out of compliance with the at least one threshold value includes determining that at least one inboard marking and at least one outboard markings are both out of compliance with the at least one threshold value.

13. The computer-based apparatus of claim 12, wherein:
the at least one threshold value includes a first distance; and,
determining that at least one inboard marking and at least one outboard markings are both out of compliance with the at least one threshold value includes:
identifying first inboard and outboard markings with smallest respective registration differences;
identifying second inboard and outboard markings with largest respective registration differences;
determining a first difference between the smallest and largest respective registration differences for the first and second inboard markings;
determining a second difference between the smallest and largest respective registration differences for the first and second outboard markings; and,
determining that the first and second differences are both greater than the first distance.

14. The computer-based apparatus of claim 13, wherein:
the at least one threshold value includes a second distance; and,
determining that at least one inboard marking and at least one outboard markings are both out of compliance with the at least one threshold value includes determining that the first and second differences are each less than the second distance.

15. A computer-based method for preventive maintenance detection for a color printer including a photoreceptor belt (PB) arranged to displace in a process direction, comprising:
storing, in a memory element of a computer:
a first distance;
computer readable instructions; and,
registration data for a plurality of markings, associated with a first color, on a surface of the PB, the registration data including for each marking in the plurality of markings, a respective registration difference, in a lateral direction orthogonal to the process direction, between a respective actual location and a respective original location; and,
executing, using a processor for the computer, the computer readable instructions to:
identify a first marking with a smallest respective registration difference;
identify a second marking with a largest respective registration difference;
determine a first difference between the smallest and largest respective registration differences;
determine that the first difference is greater than the first distance;
in response to determining that the first difference is greater than the first distance, identifying a registration error for the PB; and,
in response to identifying a registration error, transmit a signal, indicating that maintenance is required for the PB, for display.

16. The computer-based method of claim 15, further comprising:
storing a second distance in the memory element; and,
executing, using the processor, the computer readable instructions to compare the first difference to the second distance, wherein identifying a registration error for the PB includes determining that the first difference is greater than the first distance and less than the second distance.

17. The computer-based method of claim 15, wherein:
the PB includes first and second edges in the process direction;
the plurality of markings includes:
a first plurality of inboard markings proximate the first edge; and,
a second plurality of outboard markings proximate the second edge; and,
identifying a registration error for the PB includes determining that at least one inboard marking and at least one outboard markings are both out of compliance with the at least one threshold value.

18. A computer-based apparatus for preventive maintenance detection for a color printer including a photoreceptor belt (PB) arranged to displace in a process direction, comprising:
a memory element for a computer arranged to store a first distance, computer readable instructions, and registration data for a plurality of markings, associated with a first color, on a surface of the PB, the registration data including for each marking in the plurality of markings, a respective registration difference, in a lateral direction orthogonal to the process direction, between a respective actual location and a respective original location; and,
a processor for the computer configured to execute the computer readable instructions to:
identify a first marking with a smallest respective registration difference;
identify a second marking with a largest respective registration difference;
determine a first difference between the smallest and largest respective registration differences;
determine that the first difference is greater than the first distance;
in response to determining that the first difference is greater than the first distance, identifying a registration error for the PB; and,
in response to identifying a registration error, transmit a signal, indicating that maintenance is required for the PB, for display.

19. The computer-based apparatus of claim 18, wherein:
the PB includes first and second edges in the process direction;
the plurality of markings includes:
a first plurality of inboard markings proximate the first edge; and,
a second plurality of outboard markings proximate the second edge; and,
identifying a registration error for the PB includes:
identifying first inboard and outboard markings with smallest respective registration differences;
identifying second inboard and outboard markings with largest respective registration differences;
determining a first difference between the smallest and largest respective registration differences for the first and second inboard markings;
determining a second difference between the smallest and largest respective registration differences for the first and second outboard markings; and,
determining that the first and second differences are both greater than the first distance.

20. The computer-based apparatus of claim 19, wherein:
the memory element is arranged to store a second distance; and,
identifying a registration error for the PB includes determining that the first and second differences are each less than the second distance.

* * * * *